US007225596B2

(12) United States Patent
Wrass

(10) Patent No.: US 7,225,596 B2
(45) Date of Patent: Jun. 5, 2007

(54) SELF SUPPORTIVE PANEL SYSTEM

(75) Inventor: Lawrence J. Wrass, Chesterfield, MI (US)

(73) Assignee: PN II, Inc., Bloomfield Hills, MI (US)

( * ) Notice: Subject to any disclaimer, the term of this patent is extended or adjusted under 35 U.S.C. 154(b) by 450 days.

(21) Appl. No.: 10/814,391

(22) Filed: Mar. 31, 2004

(65) Prior Publication Data

US 2004/0261356 A1 Dec. 30, 2004

Related U.S. Application Data

(60) Provisional application No. 60/459,158, filed on Mar. 31, 2003.

(51) Int. Cl.
*E04B 1/00* (2006.01)
*E04C 2/30* (2006.01)

(52) U.S. Cl. ..... 52/784.14; 52/309.15; 52/270; 52/198; 52/793.1; 52/793.11; 52/794.1; 52/784.15

(58) Field of Classification Search ..... 52/783.1, 52/789.1, 784.14, 796.1, 198–200, 309.4, 52/309.14, 309.15, 793.1, 794.1, 784.15, 52/793.11, 270, 284; 428/116–118; 156/292, 156/290

See application file for complete search history.

(56) References Cited

U.S. PATENT DOCUMENTS 3,236,294 A * 2/1966 Thomason ..... 165/48.2
3,242,240 A 3/1966 Tantlinger
3,350,078 A * 10/1967 Shultz et al. ..... 228/44.3
3,462,897 A 8/1969 Weinrott
3,644,158 A * 2/1972 Strumbos ..... 156/197
3,692,606 A * 9/1972 Miller ..... 156/151
4,061,812 A * 12/1977 Gilwee et al. ..... 428/117
4,171,600 A 10/1979 Whitney, Jr.
4,269,007 A * 5/1981 Ward ..... 52/95
4,593,449 A * 6/1986 Meray-Hovarth et al. . 29/527.1
5,518,796 A * 5/1996 Tsotsis ..... 428/116
6,030,483 A * 2/2000 Wilson ..... 156/292
6,107,976 A * 8/2000 Purinton ..... 343/872
6,205,728 B1 * 3/2001 Sutelan ..... 52/309.7
6,253,530 B1 7/2001 Price et al.
6,673,415 B1 * 1/2004 Yamazaki et al. ..... 428/117
6,941,720 B2 * 9/2005 DeFord et al. ..... 52/783.14
2003/0089061 A1 * 5/2003 DeFord et al. ..... 52/309.9

OTHER PUBLICATIONS

Web archive Page from 2003 for www.kennotech.fi/en_index.html. Product Literature for KENNO tech.

Davies, J.M., 1997, "Design Criteria for Sandwich Panels for Building Construction," Proceedings of the 1997 ASME International Mechanical Engineering Congress and Exposition, Dallas, TX, Nov. 16-21, ASME, New Work, pp. 273-284.

(Continued)

*Primary Examiner*—Jeanette Chapman
(74) *Attorney, Agent, or Firm*—Dobrusin & Thennisch PC

(57) ABSTRACT

A self supporting panel system used to fabricate ceilings, floors, walls, or roofs. The panel system is assembled from a plurality of panels, each having a core that is sandwiched between opposing plate members. In a preferred embodiment, the core of each panel includes a unifying material to enhance the load bearing capacity of the panel.

19 Claims, 7 Drawing Sheets

OTHER PUBLICATIONS

Kucirka, M. J., 1989, "Analysis and Design of Sandwich Panel Residential Roof Systems," Civil Engineering, Massachusetts Institute of Technology.

Morse-Fortier, L.J., 1995, "Structural Implications of Increased Panel Use in Wood-Frame Buildings", J. Struct, Eng., 121(6), pp. 995-1003.

* cited by examiner

SELF SUPPORTIVE PANEL SYSTEM

TECHNICAL FIELD

This invention generally relates to structural panels and more particularly relates to structural panels used in fabricating ceiling, walls, floors and roofs.

BACKGROUND OF THE INVENTION

Currently, most residential (and some commercial) roof systems are constructed using trusses. Although truss based roof systems are well established, they have drawbacks. Specifically, they form only one portion of the roof system. Once they are in place, an outer sheeting (such as plywood or the like) must be placed over the trusses thereby forming a surface to which shingles or other weather resistant material is placed. Additionally a finish material such as drywall must be placed along the bottom surface of a truss if a finished ceiling is desired. Also, insulation must be installed between the trusses if an insulated environment is desire.

The present invention overcomes the above-referenced drawback by eliminating the need for both a trusses and the sheeting material by combining both functions. Additionally, the present invention can be fabricated to eliminate the need to insulate on the construction site and also eliminate the need to add drywall to the bottom portion of the trusses. Specifically, the present invention fulfils the structural load bearing function (performed by the truss) and forms the roof sheeting surface to which finished roofing material (such as shingles) can be attached.

DETAILED DESCRIPTION OF THE PREFERED EMBODIMENTS

Figure 1:
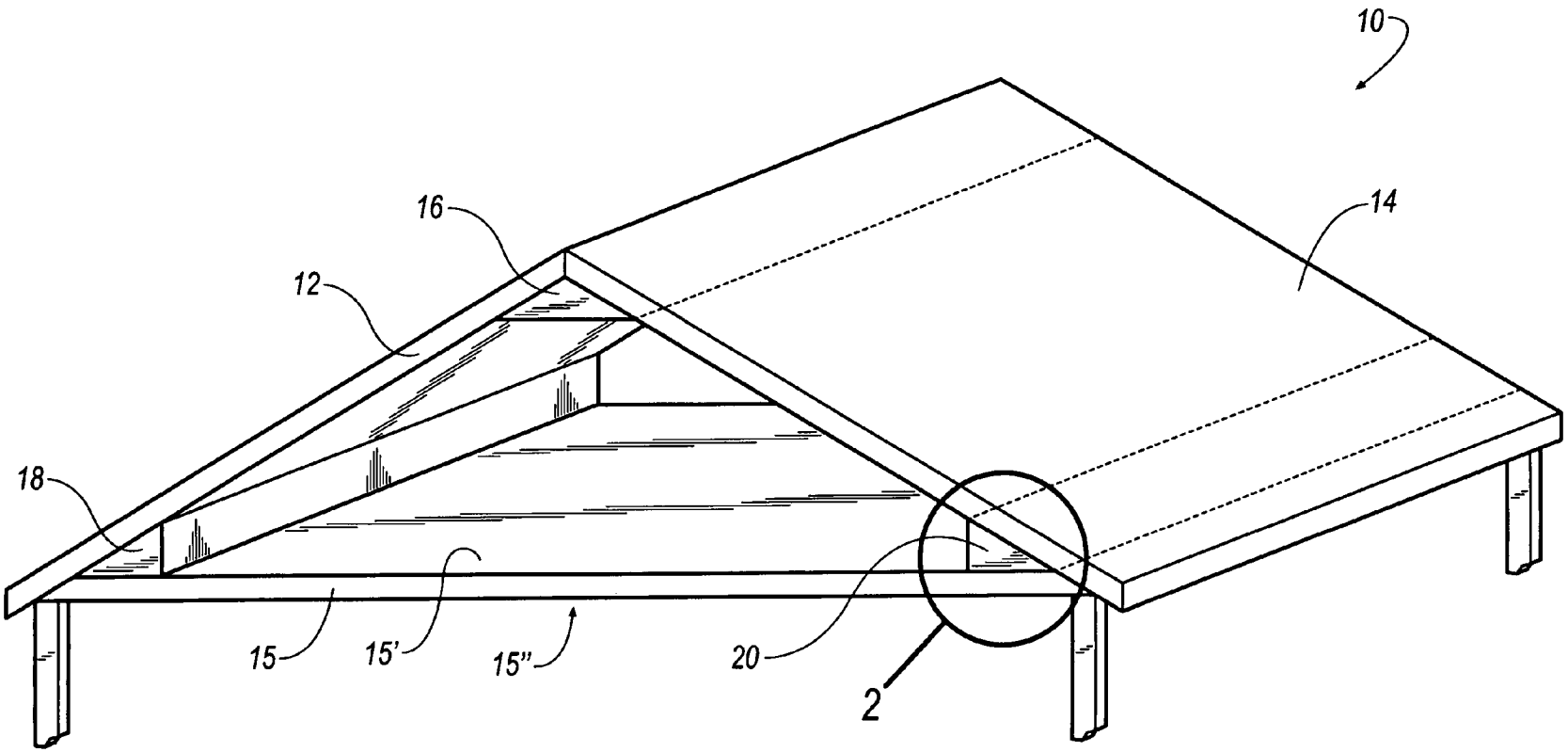
FIG. 1 is an isometric view using the panels of the present invention to construct a roof system and a ceiling system.
Figure 4:
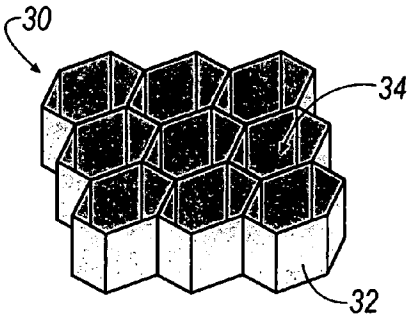
FIG. 4 is a detailed view of the honeycomb substructure of the panel of FIG. 3.
Figure 3:
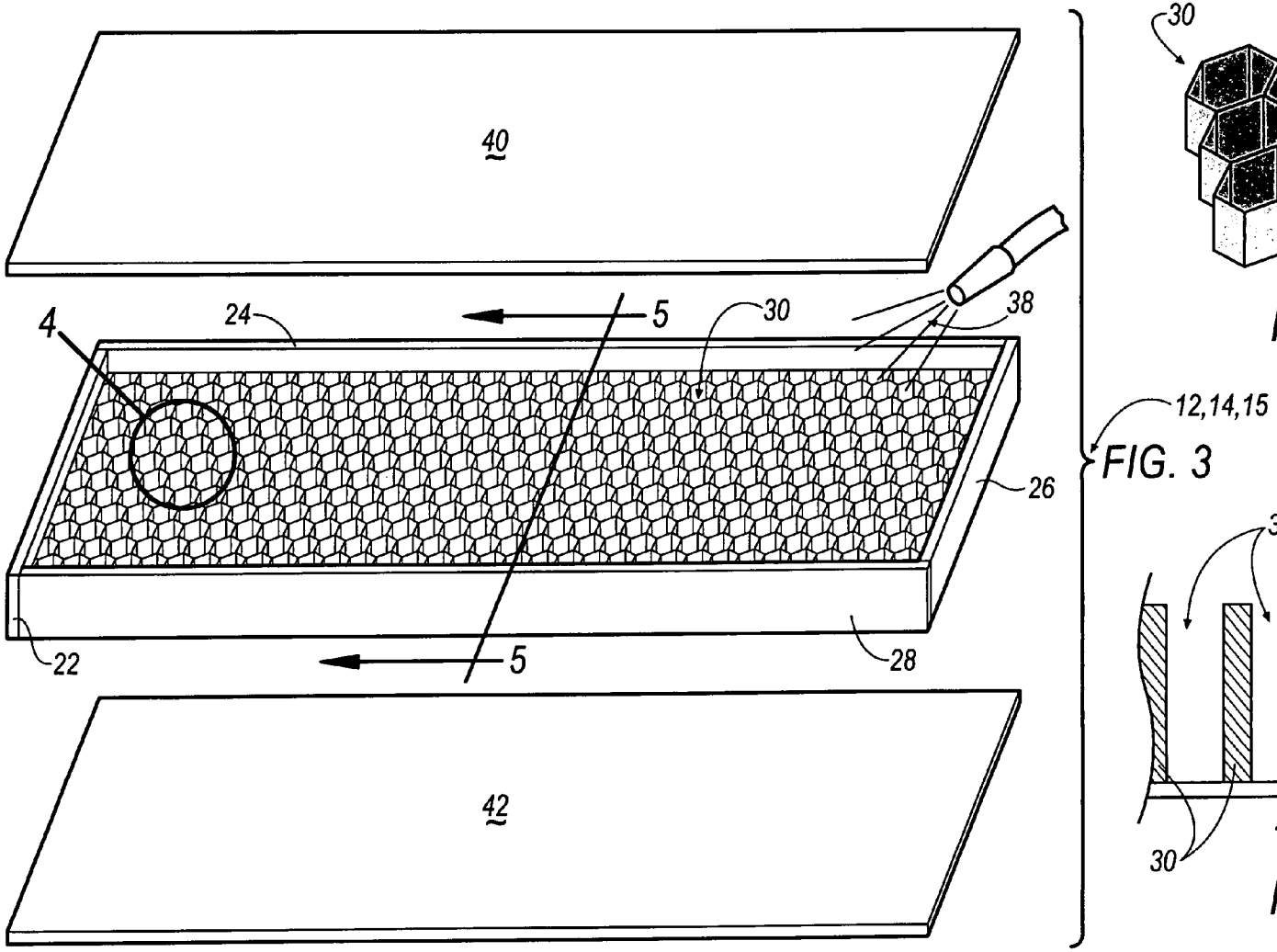
FIG. 3 is an exploded view of a first embodiment of the panel of the present invention.

Now referring to FIG. 1, roof system 10 includes panels 12 and 14 and a plurality of corner wedge members 16, 18, and 20. In a first embodiment, panels 12, 14, 15 can be constructed using the technique and materials shown in FIGS. 3–11. Specifically, FIG. 3 shows a first embodiment of panels 12, 14, 15 wherein an outer frame 22, 24, 26, and 28 is constructed in a generally rectangular shape wherein a honeycomb shaped, unifying, grid material 30 is placed in the opening formed by outer frame members 22, 24, 26 and 28 (an enlarged view of a portion of honeycomb shaped grid material 30 is shown in FIG. 4). Preferably, honeycomb shaped grid material is constructed from a plurality of hexagonal, cylindrical shaped tubes which are joined along their peripheral edges to adjacent hexagonal members. The joining of adjacent members can be done using adhesive or mechanical fasteners, or it is contemplated that the honeycomb shaped grid material 30 can be fabricated from a single integrated material such as stamped steel, injection molded plastic, fiberglass, cardboard, paper, resin, composite wood based materials or the like such that no traditional physical or adhesive joining is necessary because the member is formed in a single operation.

Each of the hexagonal members (exemplified at 32) includes an opening 34. This opening preferably passes completely through hexagonal member 32 (i.e. there is no bottom portion closing off opening 34). Once grid material 30 is placed within the opening of outer frame 22, 24, 26 and 28, a second, unifying material 38 is disposed on grid material 30 where it penetrates into, around, or through openings 34 and the fibers of grid material 30 (for materials where penetration is possible). It is contemplated that in a preferred embodiment, unifying material 38 is a urethane foam having some degree of expanding capabilities after it is sprayed. This expanding capability will cause the foam to completely fill the openings 34 in each one of the hexagonal members 32 thereby forming a strong unified panel member. After unifying material 38 is sprayed, but before the material has had any opportunity to begin substantial expansion, top and bottom plates 40, 42 are sealed against and secured to the top and bottom portions of outer frame 22, 24, 26 and 28. The completed panel 12, 14, and 15 is relatively light weight but possesses excellent strength including the ability to bear substantial loads and the ability to resist sheer, tension, compression, and racking forces.

Preferably, frame members 22, 24, 26 and 28 are fabricated from wood, metal, fiber impregnated resins, plastic, or the like. Top and bottom plates 40, 42 are preferably constructed from any material that will readily accept and retain paint and mechanical fasteners such as plywood, metal, gypsum board (or drywall), fiberglass, plastic or the like. In most applications, it is contemplated that both top and bottom plates (or sheets) 40, 42 will be constructed from material that is capable of bearing at least one of a tensile, compression, sheer, or racking load. However, it is contemplated that in some applications, the use of load bearing material for at least one of the plates 40, 42 can be eliminated and replaced with a no-load bearing material (such as gypsum board). Specifically, as shown in FIG. 1, panel 15 has two surfaces—top surface 15' and bottom surface 15". It is contemplated that top surface 15' may in some cases be fabricated from a load bearing material (such as plywood, metal or the like) but bottom surface 15" may not have to be fabricated from such a load bearing material. For example, in applications where surface 15" forms the finished ceiling of a room, it may simply be an unnecessary expense to use an expensive load bearing material for constructing surface 15".

Figure 2A:
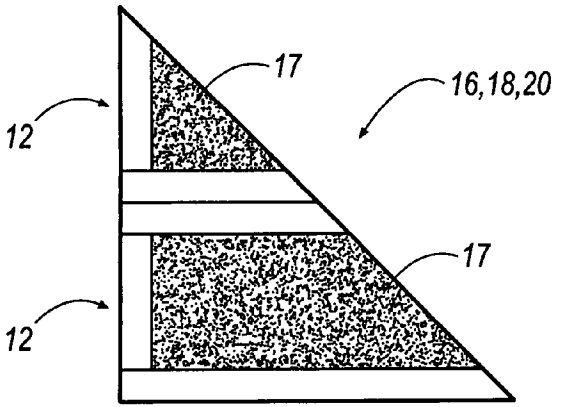
FIG. 2A is a first embodiment of the corner wedge member of the present invention.
Figure 2B:
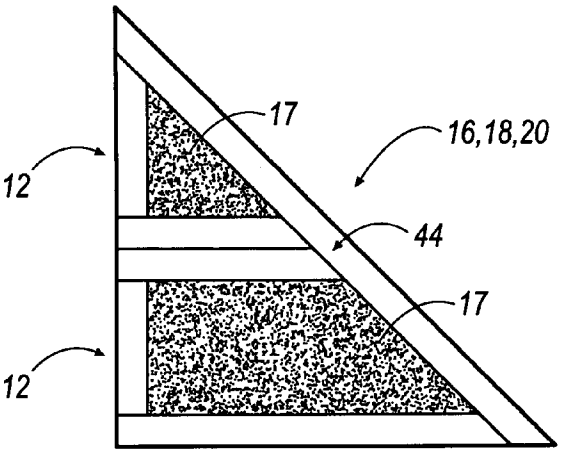
FIG. 2B is a second embodiment of the corner wedge member of the present invention.

Wedge members 16, 18 and 20 can be fabricated from any number of materials. The primary function served by wedge members 16, 18 and 20 is to join the edge portion of two adjacent panels 12, 14, and 15. Various embodiments of wedge members 16, 18 and 20 are shown in FIGS. 2A–2D. FIG. 2A shown that wedge members 16, 18, and 20 can be fabricated by cutting a panel (such as panel 12) along a diagonal line and then stacking and joining (by way of gluing or mechanical fasteners) two cut members to form a triangular shaped wedge member. In a second embodiment 2B, wedge members 16, 18, 20 are fabricated identically to the embodiment set forth in FIG. 2A, however, a finish plate 44 is placed over the foam 17 exposed end of the wedge 16, 18, and 20 thereby giving it greater structural integrity.

Figure 2C:
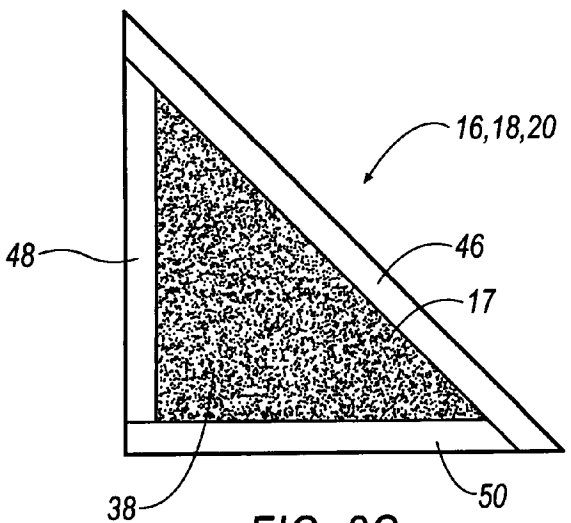
FIG. 2C is a third embodiment of the corner wedge member of the present invention.
Figure 2D:
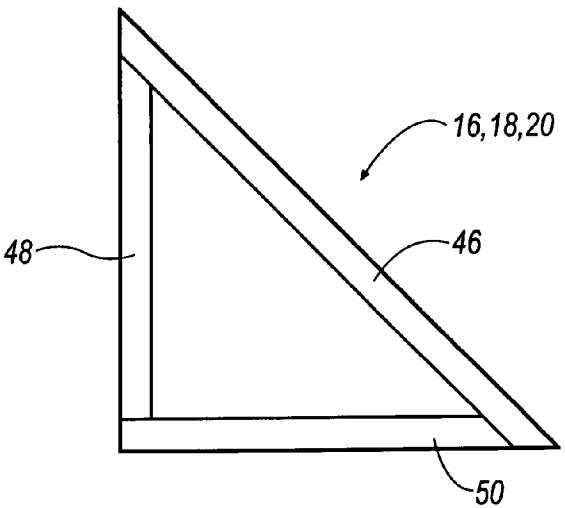
FIG. 2D is a fourth embodiment of the corner wedge member of the present invention.

In the embodiment of FIG. 2C, wedge 16, 18 and 20 is fabricated from three plate members 46, 48 and 50 which are cut and fitted against one another to form a generally triangular tubular shape. Preferably, the hollow center core formed by plate 46, 48, 50 is then filled with unifying material 38 (such as foam). It is also contemplated (see FIG. 2D) that wedge members 16, 18 and 20 can be fabricated from plates 46, 48 and 50 without the use of a unifying material 38 (simply leaving the hollow core portion formed between plates 46, 48, 50 unfilled).

Figure 5:
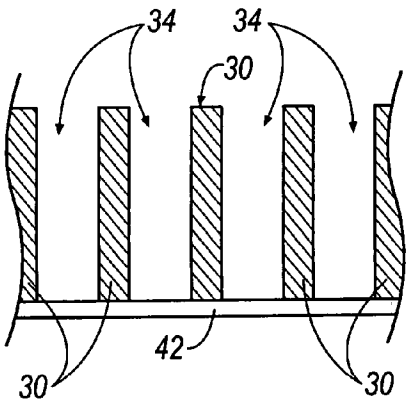
FIG. 5 is a partial cross sectional view taken substantially along lines 5—5 of FIG. 3.
Figure 6:
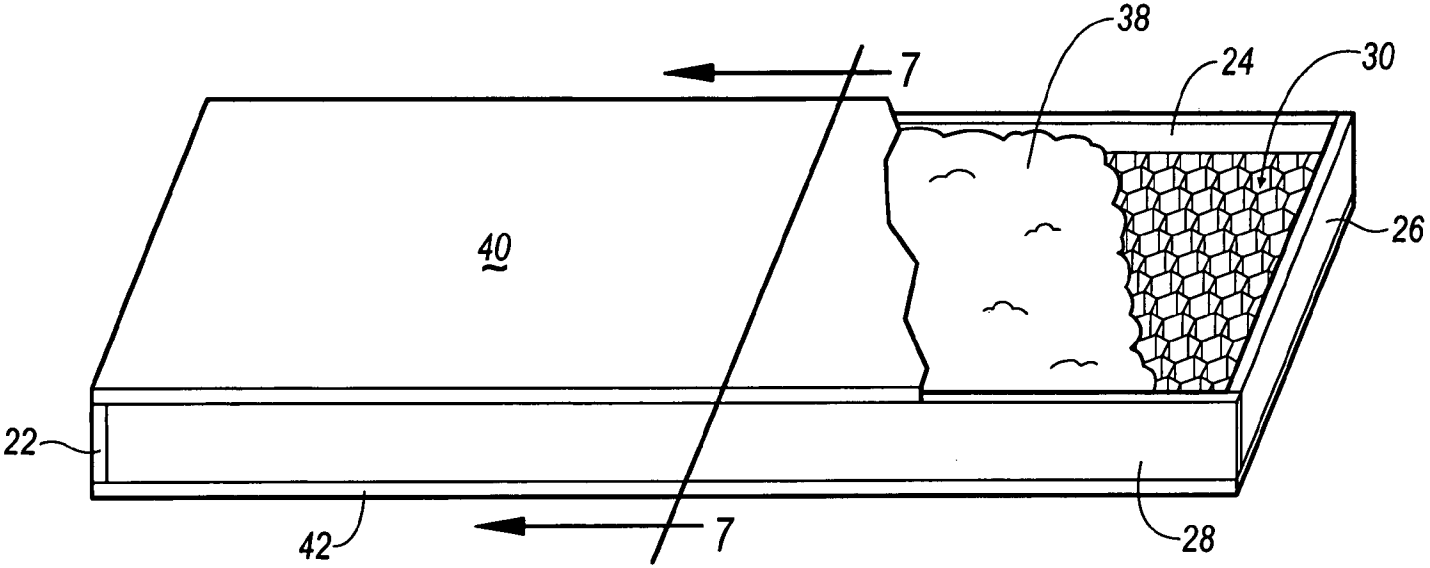
FIG. 6 is a cut away view of the panel of FIG. 3 shown substantially in an assembled position.
Figure 7:
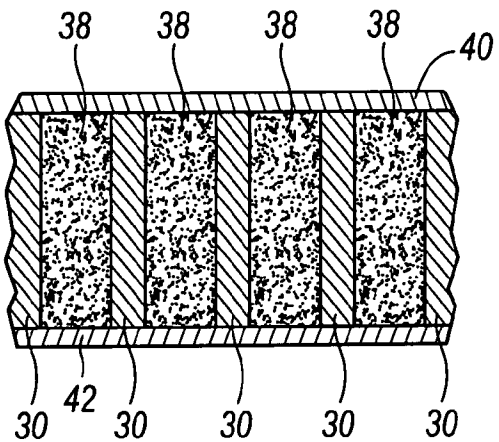
FIG. 7 is a partial cross section view taken substantially along lines 7—7 of FIG. 6.
Figures 8, 9:
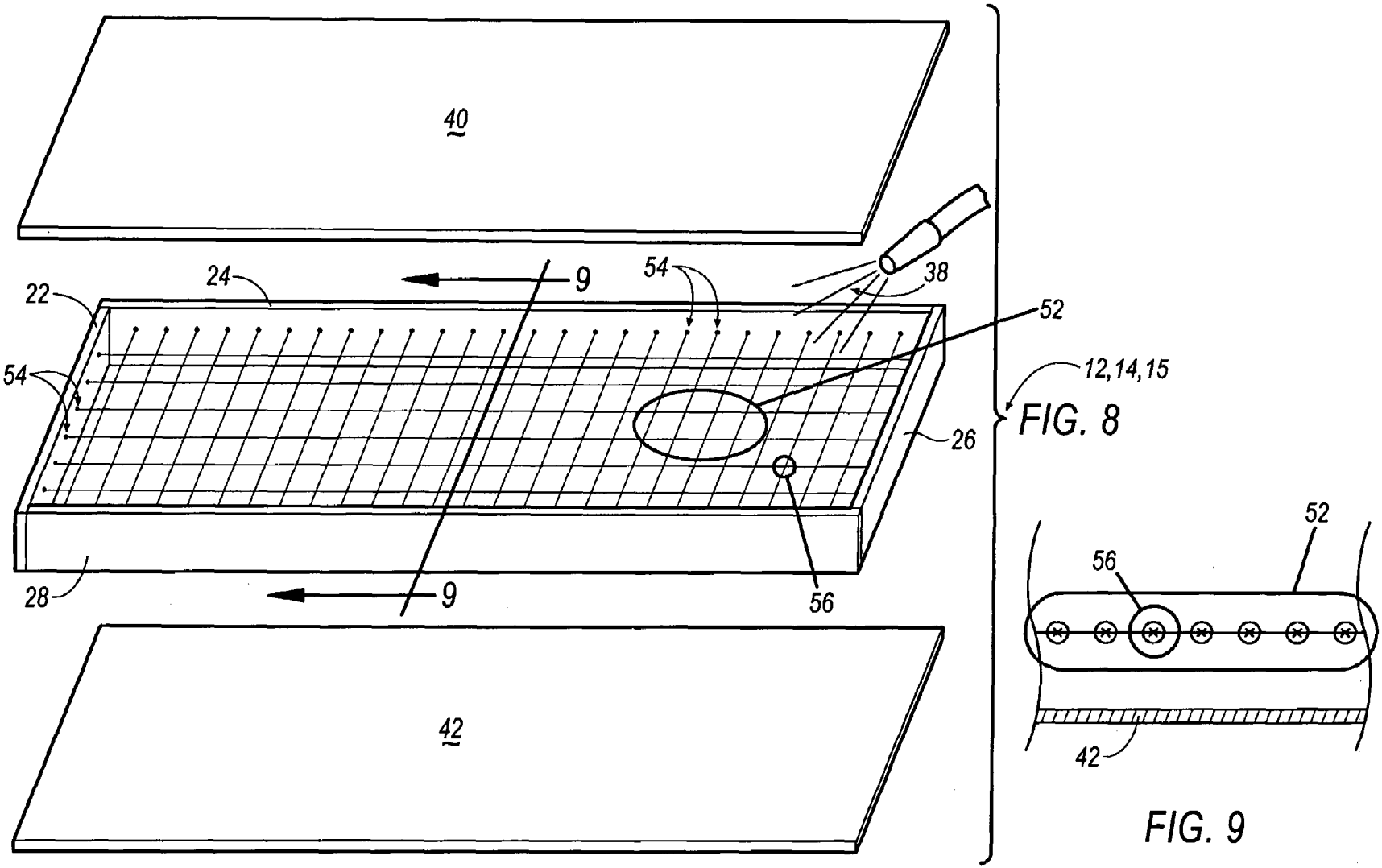
FIG. 8 is an exploded view of a second embodiment of the panel of the present invention.
FIG. 9 is a partial cross sectional view taken substantially along lines 9—9 of FIG. 8.
Figure 10:
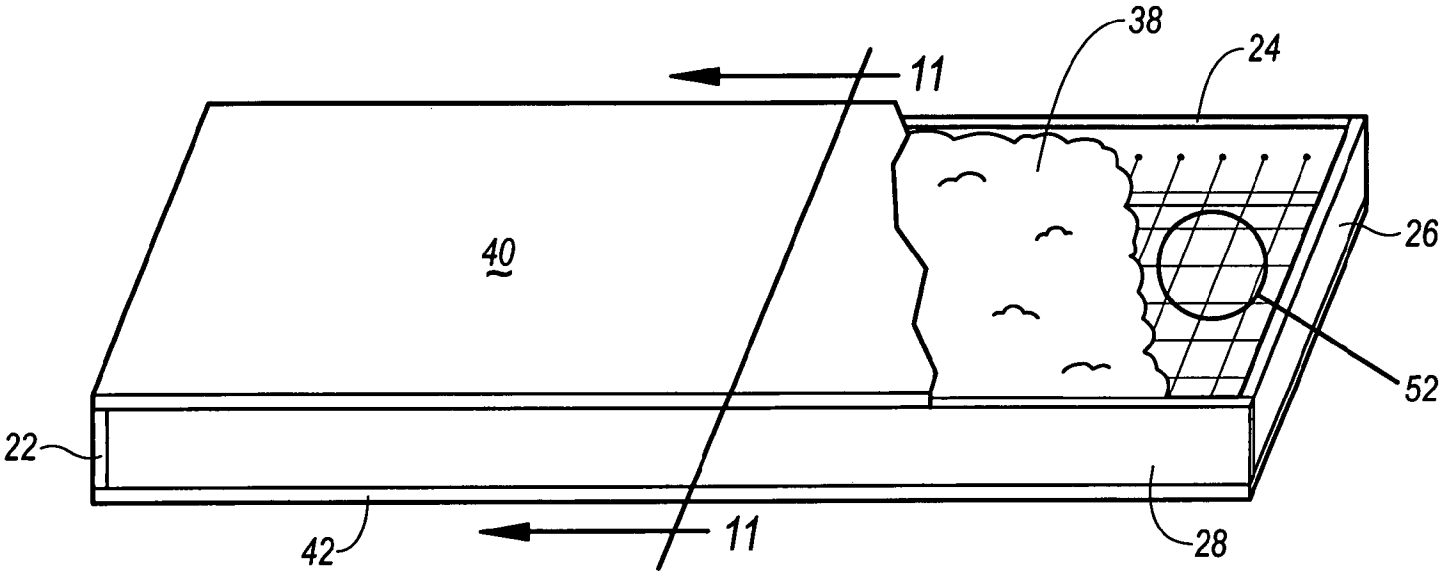
FIG. 10 is a cut away view of the panel of FIG. 8 shown substantially in its assembled condition.
Figure 11:
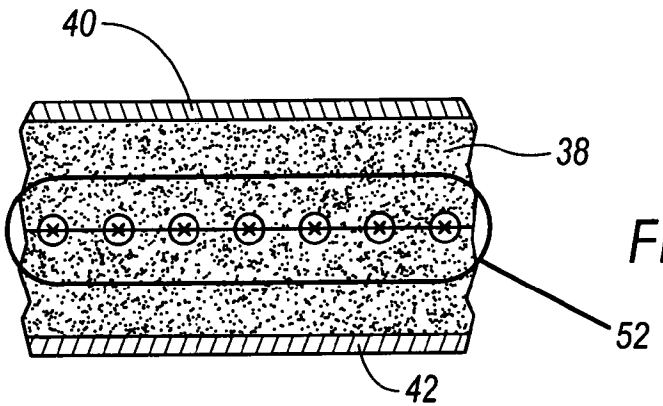
FIG. 11 is a partial cross sectional view taken substantially along lines 11—11 of FIG. 10.

FIGS. 6 and 7 show the final cut away view of the assembled panel of FIGS. 3–5.

In an alternative embodiment, FIGS. 8, 9, 10, 11 show the fabrication of an alternative embodiment of panels 12, 14, and 15. In this alternative embodiment, the frame 22, 24, 26, 28 and the top and bottom plate 40, 42 are constructed identically to that which was discussed in the embodiment of FIGS. 3–7. The only difference between the panel of FIGS. 3–7 and the panel of FIGS. 8–11 is that in the panel of FIGS. 8–11, the honeycomb shaped grid material 30 is replaced by an X–Y grid 52. It is contemplated that in a preferred embodiment, X–Y grid 52 can be fabricated from a single unitary member (such as a steel stamping, plastic stamping or plastic injection molded component, or it can be constructed from fibrous strands (such as Kevlar, fiberglass, plastic, nylon, metal, carbon or the like), wherein each strand (or group of strands) is (are) individually attached to a portion of one of the outer frames 22, 24, 26, 28. If grid 52 is constructed from individual strands or groups of strands, these strands can be routed such that they alternatively cross under and over one another at a point of contact 56 (i.e. are woven together) or, alternatively, they can be constructed such that the strands are mechanically or adhesively joined to one another at their points of contact 56. It is contemplated that superior panel strength will be achieved if the strands are mechanically or adhesively joined to one another at their points of contact 56.

It is important to note that the roof system disclosed above is self supportive in the sense that it does not rely on a traditional truss structure for its support or to support additional loading imposed by materials such as roofing material, interior walls, mechanical systems, etc. which may be added thereto. Thus, the disclosed system overcomes the shortcomings associated with the prior art roof systems (which use both trusses and sheeting material) by integrating the function of the truss and the sheeting material into a single panel component. It is also important to note that in addition to eliminating roof trusses, the inventive system, in many applications, eliminates the need for insulation inasmuch as unifying material 38 is preferably composed from materials which have superior insulating capability.

In many portions of the United States, constructing homes with basements is impractical. In these instances, the mechanical systems (heating and cooling) must either be located on the main living floor (thereby taking up valuable living space) or must be placed in the attic. The advantage of placing the mechanical systems in the attic is that valuable living space is not consumed by the mechanical system; however, because most prior art attics are not insulated, placing the mechanical systems in an uninsulated area results in inefficient operation of the mechanical system. However, the present invention overcomes the traditional inefficiencies of placing the mechanical systems in the attic because the panels disclosed herein include superior insulative properties.

It is contemplated that the roof system disclosed herein is made from plates (or sheets) formed 8 feet wide and preferably formed the length of the entire house. Thus, when these panels are used for a ceiling of a finished room, it is contemplated that spans of up to 26 feet, and perhaps greater, will be traversed without necessitating the intervention of a load bearing wall. It is also contemplated that adhesives and other similar materials (such as double sided tape) may be used to join frame members 22, 24, 26, 28 together to join panels 12, 14, 16 to wedge members 16, 18, 22, or to join top and bottom plates 40, 42 to frame 22, 24, 26, 28.

In an alternative embodiment of panels 12, 14, 16, it is contemplated that resin impregnated fiberglass material can be placed on one or more surface of top and/or bottom plate 40, 42 thereby further increasing the structural, load bearing capability of plates 40, 42 thereby increasing the load bearing capability of the overall roof system 10.

Figure 12:
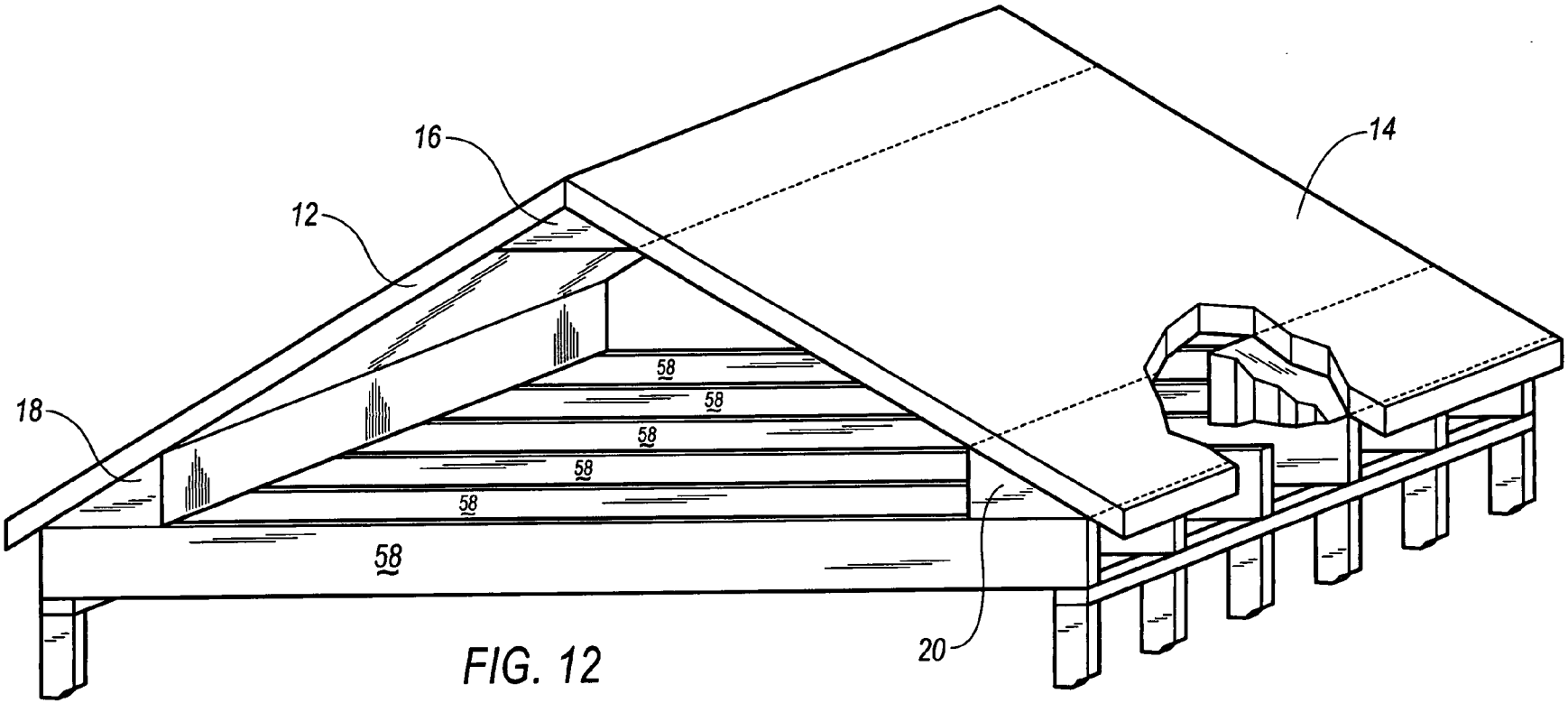
FIG. 12 is a roof structure of a home constructed using panels of the present invention in conjunction with rafter boards.

In a second embodiment of the roof system of the present invention, FIG. 12 shows a roof system similar to that of FIG. 1 except that bottom panel 15 is no longer present. It is replaced by a series of rafter boards 58. In a preferred embodiment rafter boards 58 are not directly attached to panels 12, 14, but rather are indirectly attached thereto by way of wedges 18, 20. In all other ways, the second embodiment set forth in FIG. 12 is identical to that which has been discussed in conjunction with the embodiment of FIG. 1.

What is claimed is:

1. A roof structure, comprising:

a first structural roof panel, including opposing spaced apart load bearing plates and a structure for maintaining the plates in spaced apart relation, a second structural roof panel, including opposing spaced apart load bearing plates and a structure for maintaining the plates in spaced apart relation, and a horizontally extending cross-tie structure, wherein the first and second structural panels are joined together along respectively associated adjacent edges for defining an attic space that is free of a truss structure for supporting the roof panels, wherein the third cross-tie panel is connected between the first and second structural roof panels, wherein at least one of the first, second, or third panel includes, a core, having first and second opposing faces, a first plate attached to the first core face, a second plate attached to the second core face, wherein at least one of the panels is insulated and at least one of the panels carries a plastic foam.

2. The roof structure of claim 1, wherein the first and second structural roof panels are fastened together by way of a wedge member.

3. The roof structure of claim 2, wherein the cross-tie structure is connected between and connected to at least one of the first and second structural roof panels by way of a wedge member.

4. The roof structure of claim 1, wherein the third, cross-tie panel is connected between at least one of the first and second structural roof panels by way of a wedge member.

5. The roof structure of claim 3, wherein the wedge member is triangular.

6. The roof structure of claim 1, wherein the cross-tie structure is a panel that includes opposing spaced apart plates, at least one of which is load-bearing and a structure for maintaining the plates in spaced apart relation.

7. The roof structure of claim 6, wherein at least one of the load bearing plates in the first and second structural roof panels, and the cross-tie panel is metal.

8. The roof structure of claim 2, wherein the wedge member includes a hollow core portion.

9. The roof structure of claim 2, wherein the wedge member is fabricated from the same type of material used to fabricate at least one of the first or second structural panels.

10. The roof structure of claim 6, wherein only one of the opposing plates is load bearing in the cross tie panel.

11. A self-supportive insulated structure for a house, comprising:

a first insulated structural roof panel, including opposing spaced apart load bearing plates and a structure for maintaining the plates of the first structural panel in spaced apart relation, a second insulated structural roof panel, including opposing spaced apart load bearing plates and a structure for maintaining the plates of the second structural panel in spaced apart relation, a third, horizontally extending cross-tie panel, including opposing spaced apart load bearing plates and a structure for maintaining the plates of the third cross-tie panel in spaced apart relation, wherein the first and second panels are inclined relative to the third panel, and are joined together along respectively associated adjacent edges for defining an attic space that is free of a truss structure for supporting the roof panels, wherein said third, cross-tie panel is connected between said first and second structural roof panels, and one of the plates of the third cross-tie panel of the attic space defines a floor, wherein at least the first and second structural roof panels include a metal plate that carries a plastic foam; and a system for heating and cooling the house located in the attic space.

12. The roof structure of claim 11, wherein the third, cross-tie panel is connected between the first and second structural roof panels by way of a wedge member.

13. The roof structure of claim 11, wherein the support structure defines a plurality of tubes.

14. The roof structure of claim 12, wherein the support structure defines a plurality of tubes.

15. A self-supportive insulated structure for a house, consisting essentially of:

a first insulated roof panel, including opposing spaced apart metal load bearing plates and a support structure for maintaining the plates of the first roof panel in spaced apart relation, a second insulated roof panel, including opposing spaced apart load bearing plates and a support structure for maintaining the plates of the second roof panel in spaced apart relation, a third, horizontally extending cross-tie panel, including opposing spaced apart load bearing plates and a support structure for maintaining the plates of the third cross-tie panel in spaced apart relation, a first wedge;

a second wedge; and a third wedge;

wherein the first and second panels are inclined relative to the third panel, and are joined together along respectively associated adjacent edges, with the first wedge disposed therebetween, for defining an attic space that is free of a truss structure for supporting the roof panels, wherein said third, cross-tie panel is connected between said first and second roof panels, the second wedge being disposed along one edge of the cross-tie panel between the first roof panel and the cross-tie panel, and the third wedge being disposed along another edge of the cross-tie panel between the second roof panel and the cross-tie panel;

wherein one of the load bearing plates of the cross-tie panel defines a floor for the attic space; and wherein at least the first and second roof panels include a metal plate that carries a plastic foam.

16. The roof structure of claim 14, wherein all of the load bearing plates are metal.

17. The roof structure of claim 15, wherein the support structure defines a plurality of tubes.

18. The roof structure of claim 16, wherein the load bearing plates have a flat exterior surface.

19. The roof structure of claim 18, wherein the attic space has a heating and cooling system for the house located therein.

* * * * *

UNITED STATES PATENT AND TRADEMARK OFFICE
Certificate

Patent No. 7,225,596 B2 Patented: June 5, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Lawrence J. Wrass, Chesterfield, MI (US); James K. Petersen, Clarkston, MI (US); and Robert Patrick Broad, Ypsilanti, MI (US).

Signed and Sealed this Eighth Day of February 2011.

BRIAN GLESSNER
*Supervisory Patent Examiner*
Art Unit 3633
Technology Center 3600